US006109338A

United States Patent [19]

Butzer

[11] Patent Number: 6,109,338

[45] Date of Patent: Aug. 29, 2000

[54] ARTICLE COMPRISING A GARMENT OR OTHER TEXTILE STRUCTURE FOR USE IN CONTROLLING BODY TEMPERATURE

[75] Inventor: Melissa J. Butzer, Houston, Tex.

[73] Assignee: Oceaneering International, Inc., Houston, Tex.

[21] Appl. No.: 08/848,799

[22] Filed: May 1, 1997

[51] Int. Cl.[7] ..... A41D 13/00

[52] U.S. Cl. ..... 165/46; 62/259.3; 607/104

[58] Field of Search ..... 165/46; 62/259.3; 126/204; 607/104

[56] References Cited

U.S. PATENT DOCUMENTS

| | | | |
|---|---|---|---|
| 3,085,405 | 4/1963 | Frantti . | |
| 3,112,792 | 12/1963 | Coleman, Jr. et al. | 165/46 |
| 3,154,926 | 11/1964 | Hirschhorn . | |
| 3,211,216 | 10/1965 | Coleman et al. . | |
| 3,242,979 | 3/1966 | Shlosinger . | |
| 3,279,201 | 10/1966 | Wortz et al. . | |
| 3,289,748 | 12/1966 | Jennings . | |
| 3,295,594 | 1/1967 | Hopper . | |
| 3,345,641 | 10/1967 | Jennings . | |
| 3,400,756 | 9/1968 | Cogswell . | |
| 3,425,060 | 2/1969 | Glaser et al. . | |
| 3,425,486 | 2/1969 | Burton et al. . | |
| 3,425,487 | 2/1969 | Tucker . | |
| 3,430,688 | 3/1969 | Crocker . | |
| 3,479,838 | 11/1969 | Bitterly . | |
| 3,507,321 | 4/1970 | Palma . | |
| 3,630,039 | 12/1971 | Hayashi . | |
| 3,674,034 | 7/1972 | Hardy . | |
| 3,738,367 | 6/1973 | Hardy . | |
| 3,743,012 | 7/1973 | Laxo . | |
| 3,744,053 | 7/1973 | Parker et al. . | |
| 3,744,555 | 7/1973 | Fletcher et al. . | |
| 3,869,871 | 3/1975 | Rybalko et al. . | |
| 3,916,911 | 11/1975 | Sauder et al. . | |
| 3,995,621 | 12/1976 | Fletcher et al. . | |
| 4,024,730 | 5/1977 | Bell et al. . | |
| 4,033,354 | 7/1977 | De Rosa . | |
| 4,095,593 | 6/1978 | Webbon et al. . | |
| 4,118,946 | 10/1978 | Tubin . | |
| 4,132,262 | 1/1979 | Wibell . | |
| 4,162,764 | 7/1979 | Millsap . | |
| 4,170,998 | 10/1979 | Sauder . | |
| 4,172,454 | 10/1979 | Warncke et al. . | |
| 4,172,495 | 10/1979 | Zebuhr et al. . | |
| 4,194,247 | 3/1980 | Melander . | |
| 4,405,348 | 9/1983 | Pasternack . | |
| 4,459,822 | 7/1984 | Pasternack . | |
| 4,523,594 | 6/1985 | Kuznetz . | |
| 4,566,455 | 1/1986 | Kramer . | |
| 4,569,087 | 2/1986 | Kerwin . | |
| 4,662,433 | 5/1987 | Cahn et al. . | |
| 4,691,762 | 9/1987 | Elkins et al. . | |
| 4,696,066 | 9/1987 | Ball et al. | 2/272 |
| 4,718,429 | 1/1988 | Smidt . | |

(List continued on next page.)

FOREIGN PATENT DOCUMENTS

| | | |
|---|---|---|
| 0287294 | 10/1988 | European Pat. Off. . |
| 1231184 | 12/1966 | Germany . |
| 9420387 | 2/1995 | Germany . |
| 8302562 | 8/1983 | WIPO . |

OTHER PUBLICATIONS

Design Patent Licensure Opportunity; Thermoelectric Cooling for Protective Clothing from Midwest Research Institute (MRI), faxed to OSS on May 23, 1996, (6 pages).

*Primary Examiner*—Allen Flanigan
*Attorney, Agent, or Firm*—Marvin B. Eickenroht; Kurt S. Myers

[57] ABSTRACT

There is disclosed an article for use in cooling body temperature which comprises a garment having a coat and pant, with each having a body section adapted to receive a portion of the torso of the wearer and extensions from the body section to receive the wearer's limbs. The garment includes a system for circulating temperature controlling fluid from a suitable source through patches removably received in pockets in each of body section and extensions.

25 Claims, 9 Drawing Sheets

U.S. PATENT DOCUMENTS 4,738,119 4/1988 Zafred .
4,753,242 6/1988 Saggers .
4,807,447 2/1989 Macdonald et al. .
4,962,761 10/1990 Golden .
4,998,415 3/1991 Larsen .
5,062,269 11/1991 Siegel .
5,090,053 2/1992 Hayes .
5,097,829 3/1992 Quisenberry .
5,201,365 4/1993 Siegel .
5,214,926 6/1993 Mandin et al. .
5,224,349 7/1993 Siegel .
5,269,369 12/1993 Faghri .
5,305,471 4/1994 Steele et al. ..... 2/102
5,320,164 6/1994 Szczesuil et al. .
5,330,519 7/1994 Mason et al. .
5,344,436 9/1994 Fontenot et al. .
5,345,995 9/1994 Yano et al. .
5,357,758 10/1994 Andonian .
5,363,663 11/1994 Chen .
5,375,430 12/1994 Siegel .
5,386,701 2/1995 Cao .
5,386,823 2/1995 Chen .
5,415,222 5/1995 Colvin et al. .
5,417,720 5/1995 Mason .
5,456,701 10/1995 Stout .
5,460,012 10/1995 Kwok .
5,470,353 11/1995 Jensen .
5,511,542 4/1996 Hall .-

FIG. 11
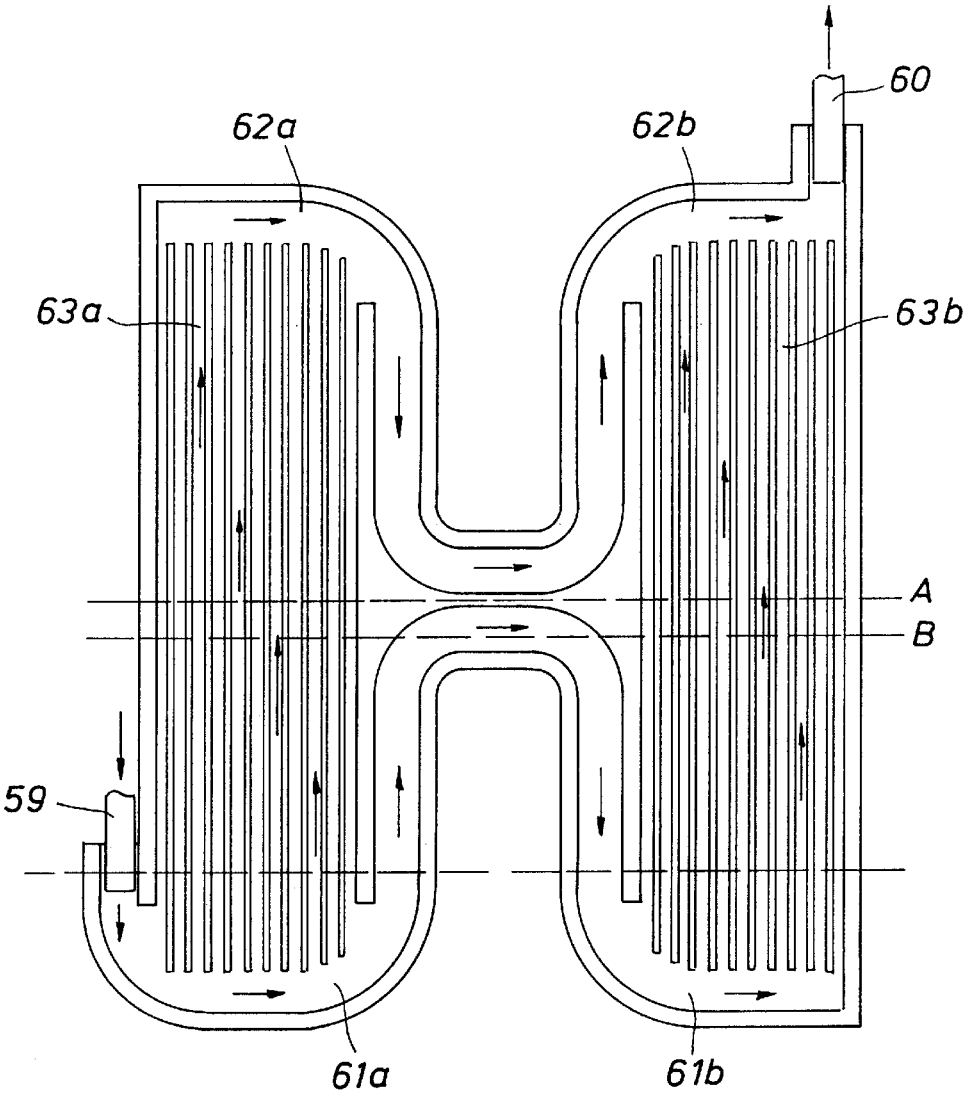
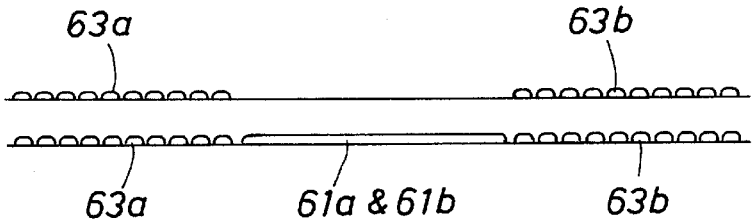
FIG. 11a
FIG. 11b
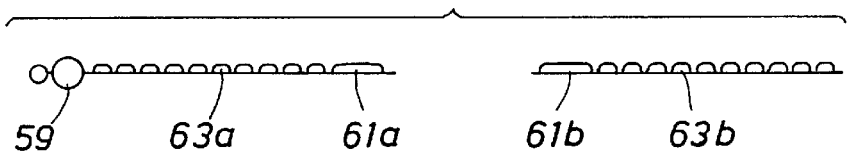

ARTICLE COMPRISING A GARMENT OR OTHER TEXTILE STRUCTURE FOR USE IN CONTROLLING BODY TEMPERATURE

This invention was made with Government support under Contract No. DE-AC21-93MC30178 awarded by the Department of Energy. The Government has certain rights in this invention.

BACKGROUND OF THE INVENTION

This invention relates generally to an article comprising a garment or other textile structure for use in controlling the body temperature of the wearer. More particularly, it relates to improvements in such an article of the type having a system for circulating temperature controlling fluid therethrough.

There are many instances in which a person may need protective clothing to help maintain a safe and comfortable body core temperature regardless of the surrounding environment. The most common example may be wearing additional layers of clothing when in a cold climate. Maintaining a normal core temperature in a hot environment is more difficult. The body's only defense against extreme heat is to sweat and cool the blood at the skin's surface through the evaporation of the sweat moisture. This system of sweat and evaporation is not effective in extreme heat and as sweating increases so does the fluid loss of the individual.

Another option has been to increase the evaporation of sweat moisture. This is usually accomplished with additional airflow. The air can be supplied to the interior of a garment or through a perforated tubing harness. Although these systems increase cooling capabilities, they overwork the body's natural cooling system and can lead to excess fluid loss for the user.

Some attempts have been made to supply a source of cooling to the skin surface. One idea has been to provide a vest style garment that contains ice or similar frozen packages. Not only is the extreme temperature differential uncomfortable to the wearer, but it can result in vasoconstriction of the skin surface blood vessels. This vasoconstriction stops the supply of body heat to the skin surface. Additionally, this type of system only provides localized cooling to specific areas.

Another option is a suit having a system through which a temperature controlling fluid may be circulated. These suits are usually constructed of tubing sewn to a stretch garment. Most of these suits limit the amount of tubing to control cost and use colder fluid to compensate for the lack of cooling fluid surface area. This concept can also result in a vasoconstriction problem and localized cooling.

The most successful of the tube suits has over 375 feet of tubing which is expensive and time consuming to produce. However, the increased surface area does allow for warmer water than the previous designs. The smaller temperature differential between skin temperature and water temperature reduces the risk of vasoconstriction and greatly increases the comfort of the user. The increased surface area also provides more even cooling to the user.

In any event, however, none of these solutions allow for easy maintenance or replacability of a single circuit or area. They also result in less comfortable garments because the tubing or frozen packages change the characteristics of the textile that support it. This is because the tubing or frozen packages do not have the same pliable, stretchable characteristics that the garment textiles do. To construct a garment that holds the cooling element close enough to the skin and moves with the wearer effectively, requires textile characteristics that are not easily compatible with typical tubing or other fluid holding materials.

Therefore, the problem of how to provide effective surface area with a fluid temperature that is comfortable still remains. What also remains a challenge is the interface or connection of the fluid conduit system to the garment.

It is therefore the primary object of the current invention to provide a garment or other textile structure with a fluid circulating system that achieves optimum surface area for the body or part to be cooled or heated and operates at a comfortable and safe temperature differential relative to the wearer's skin temperature, and which does so with a minimum of constraint and discomfort associated with prior articles of this type.

SUMMARY

The invention is comprised of a garment or other article with a fluid circulating system which is intended to control the body core temperature of the user by providing cooling or heating to the skin surface. The circulating fluid system is constructed from a plurality of patches or bladders, having side by side flow passages with headers at each end, which are connected to one another by tubing. The bladders or patches are produced by RF welding two layers of a watertight, sealable film together along the edges and internally to form the flow passages which direct the fluid from the inlet header to the outlet header. The inlet and outlet of the individual patches are formed by RF welding sealable tubing into openings in the headers. Parallel flow is provided to the entire system by manifold patches with a central inlet or outlet and multiple patch circuit inlets or outlets. Separate circuits are provided for each limb, major muscle, or body area. The patches are lined into circuits or to the manifolds by tubing. This tubing is joined to the inlet and outlet tubes of the patch preferably by gluing or by other conventional tube connection methods.

For some body areas the parallel flow within the patch is achieved through an H-style patch. These patches are intended to extend around a limb and provide fluid flow to the front and back while leaving the sides mostly unencumbered. The inlet side of the H-patch allows the flow to split at the inlet so both sides of the patch flow to the outlet in parallel. Some of the flow is directed through the bottom header to the opposite side of the H, through the vertical flow channels, and to the outlet. The remainder of the flow goes through the near set of vertical flow channels, through the top header to the opposite side, and to the outlet.

The patches provide a maximum amount of surface area with a minimal volume of fluid. A single patch provides more available surface area than its equivalent weight or volume in tubing. The parallel circuits allow for a more even application of the inlet fluid temperature and the even application allows for a smaller temperature differential between the skin surface and the fluid. This evenness and small differential increases the user comfort by decreasing the perception of hot or cold spots in the circulating fluid.

The fluid circulating system is supported by a textile structure or garment which allow it to be held or worn close to the body. Preferably, the fluid circulating system is supported by a stretch fabric garment that holds it close to the user's body. This accomplishes the maximum amount of contact between the surface area of the patches and the user. The patches are contained within pockets placed on the outside of the garment. The tubing is threaded through casings formed by stitching strips of fabric to the foundation garment. The casings extend from pocket to pocket to hold the lengths of tubing that connect the patches. Small openings are left at the edges of the pockets to allow the tube casings to underlap the pockets slightly. The ends of the tube casings are open so the tubing exits the casing inside the pocket and joins to the patch.

Because the characteristics of textiles and the fluid circulating tubes or patches are not typically compatible, the textile structure and the fluid system must move independently of each other. As the user moves the textile structure, the patches or tubing will react differently. Usually the textile is designed to follow a user's body, but patches and tubing (lo not inherently have that quality. By allowing the patches and tubing to float or slip within the casings and pockets the assembly of the two can behave like a typical garment or textile. This same system of pockets and casings also allows for easy inspection, repair, or replacement of the tubes or patches.

When such a garment is configured for an emergency or industrial worker, it is preferably a coat and pant of a stretchable fabric. The patches are typically made from a polyurethane film that is durable, flexible, and watertight. The tubing is usually glued to the patch inlets or outlets. Preferably there are circuits for each calf, each thigh, each arm, and the torso. The calf and thigh circuits are manifolded through the pant manifold patches. The arm, chest, and back circuits are manifolded through the coat manifold patches. A supply and a return tube on the pant connects to a supply and return tube on the coat. A separate set of supply and return tubes are located on the coat and provide connection of the entire system to the source of fluid circulation and temperature control. That source may be any one of several options including a thermoelectric chiller or liquid air breathing apparatus.

DESCRIPTION OF THE DRAWINGS

A more particular description of the invention briefly summarized above can be had by reference to the preferred embodiments illustrated in the drawings in this specification so that the manner in which the above cited features, as well as others that will become apparent, are obtained and can be understood in detail. The drawings illustrate only preferred embodiments of the invention and are not to be considered limiting of its scope as the invention will admit to other equally effective embodiments. In the drawings:

FIG. 11 is a diagram showing the shape and flow paths of a typical H-style patch.

FIGS. 11A and 11B are cross-sectional views of the patch of FIG. 11, as seen along broken lines 11A and 11B thereof.

DETAILED DESCRIPTION OF THE PREFERRED EMBODIMENT

With reference now to the details of the above described drawings, and, as previously mentioned, the garment has pockets and tube casings to support the patches and tubing, and the pockets have an opening on at least one edge to allow access to the interior of the pockets and the tube casing ends. These openings are covered by pocket flaps which keep the pocket closed for normal use. The pockets are sewn on the outside of the garment with the pocket flaps overlapping the pockets. The tube casings are sewn to the outside of the garment with the ends underlapping the pocket edges. The ends of the tube casings are left open to allow the tubing to enter the pocket and be glued to an inlet or outlet to the header at one end of the flow passage of the patch.

Figure 1:
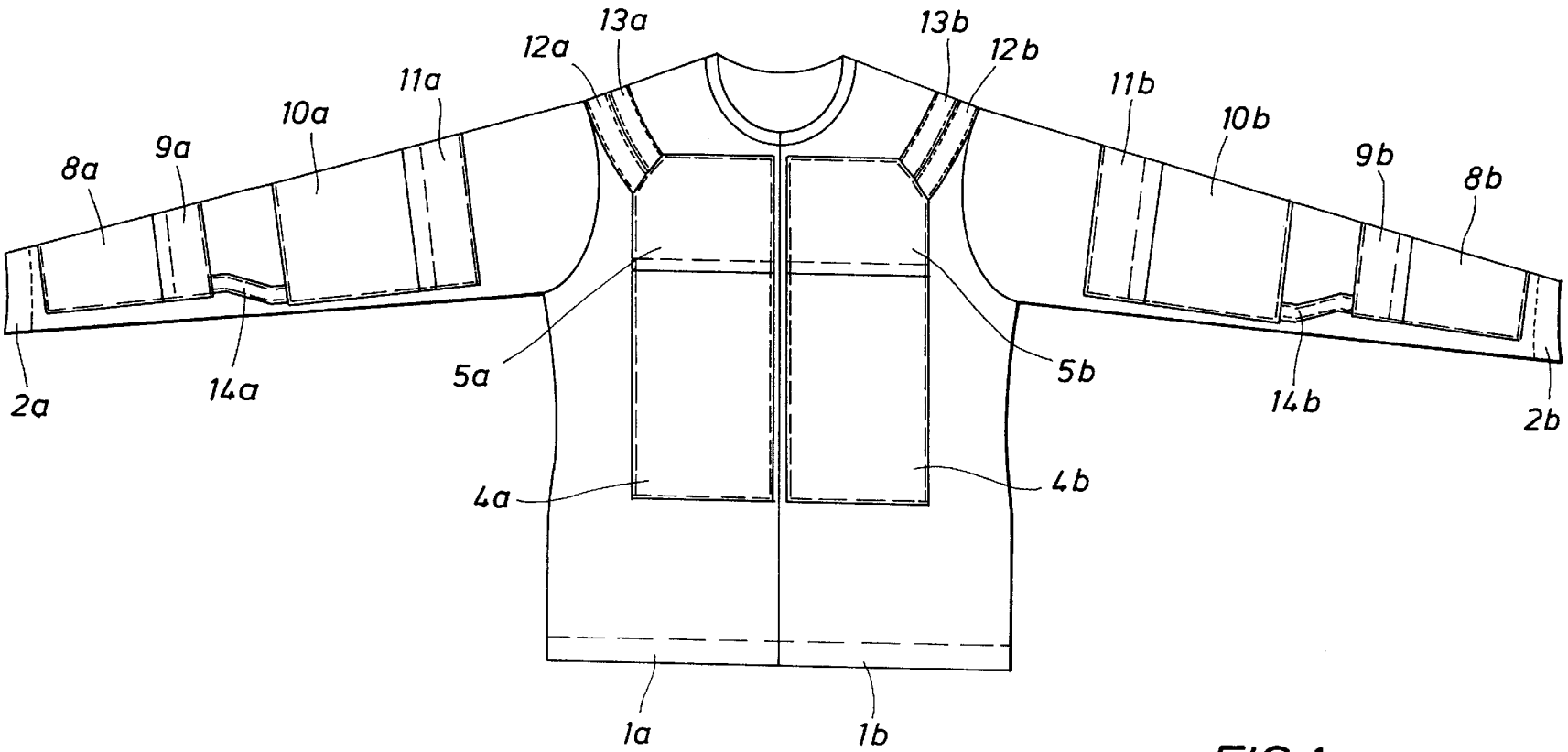
FIG. 1 is a front view of the preferred embodiment of the fabric component of the garment coat with pockets and tubing casings.
Figure 2:
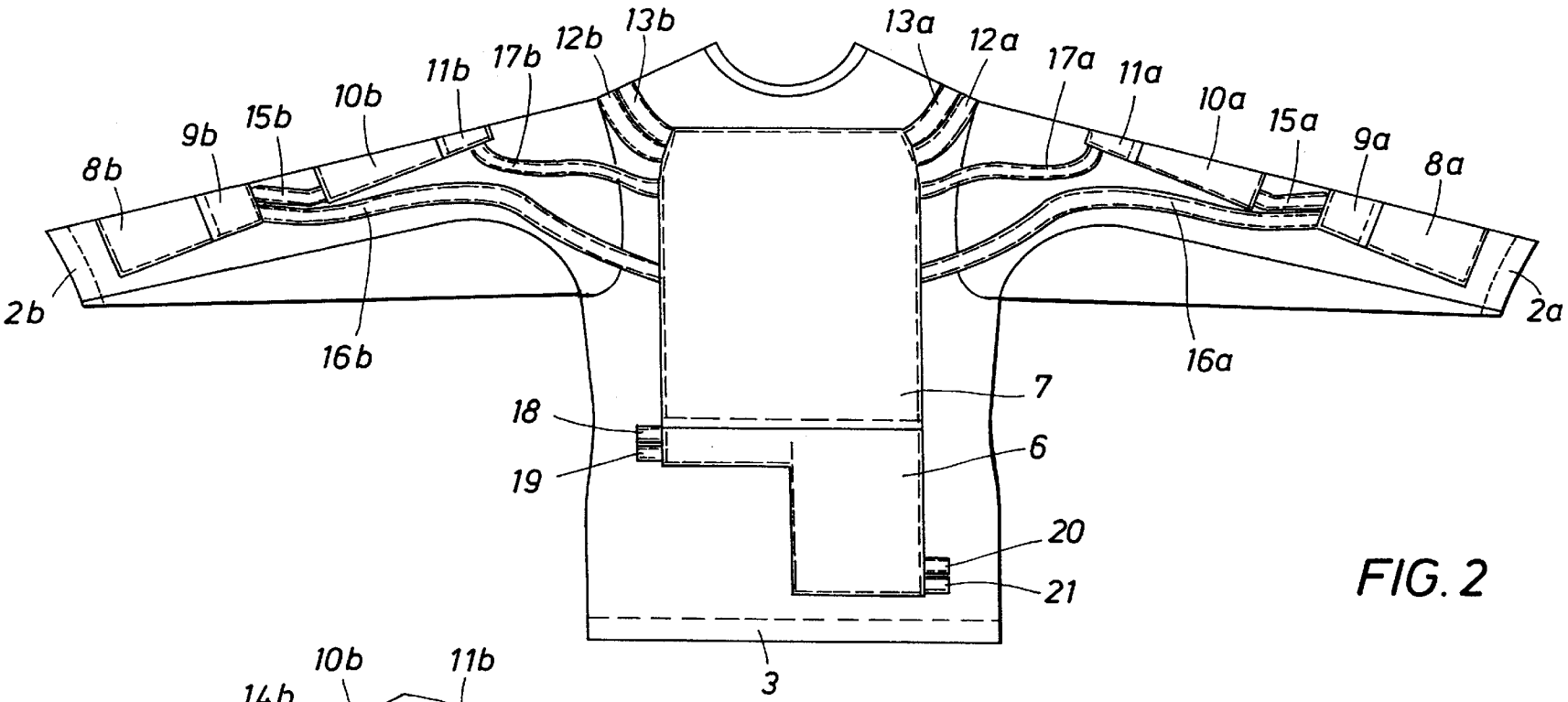
FIG. 2 is a back view of the preferred embodiment of the fabric component of the garment pant with pockets and tubing casings.
Figure 2A:
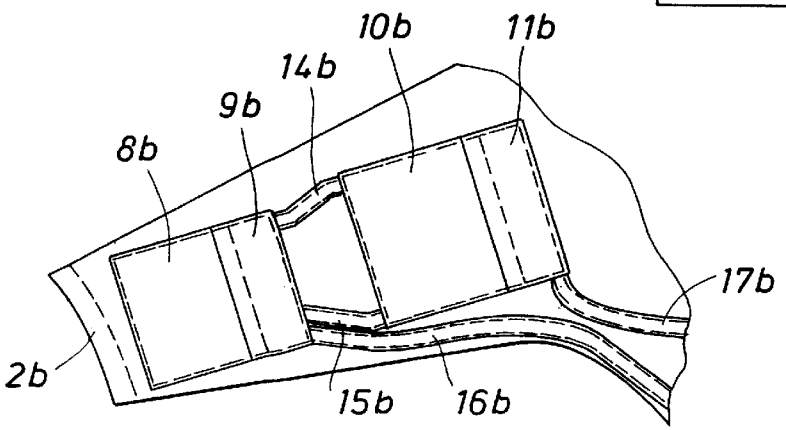
FIG. 2A is a view of the left sleeve of the garment of FIGS. 1 and 2, as seen from the top and opened flat.

The coat in FIGS. 1 and 2 is of a typical pattern construction with right 1*a* and left 1*b* front torso pieces, right 2*a* and left 2*b* extension sleeve pieces, and a back 3 torso piece. The sections of the coat are sewn together using typical seaming methods appropriate for the textile. The fronts 1*a*,1*b* of the coat are each provided with pockets 4*a*,4*b* and pocket flaps 5*a*,5*b*. The back 3 of the coat has a pocket 6 and pocket flap 7. The sleeves 2*a*,2*b* of the coat have lower pockets 8*a* and 8*b*, upper pockets 10*a* and 10*b*, and pocket flaps 9*a* and 9*b*, 11*a* and 11*b*.

The front pockets 4*a*,4*b* are connected to the back pocket 6 with the tube casings 12*a*,12*b* and 13*a*,13*b*. The sleeve pockets 8*a*,8*b* are connected to sleeve pockets 10*a*,10*b* respectively with tube casings 14*a*,14*b* and 15*a*,15*b*. The lower sleeve pockets 8*a*,8*b* are connected to the back pocket 6 with tube casings 16*a*,16*b*. The upper sleeve pockets 10*a*,10*b* are connected to the back pocket 6 with tube casings 17*a*,17*b*. The tube casings 18,19 are to accommodate the supply and return tubes to the fluid supply, and the tube casings 20,21 are to accommodate the supply and return tubes between the coat and the pant, as will be described in more detail to follow.

Figure 4:
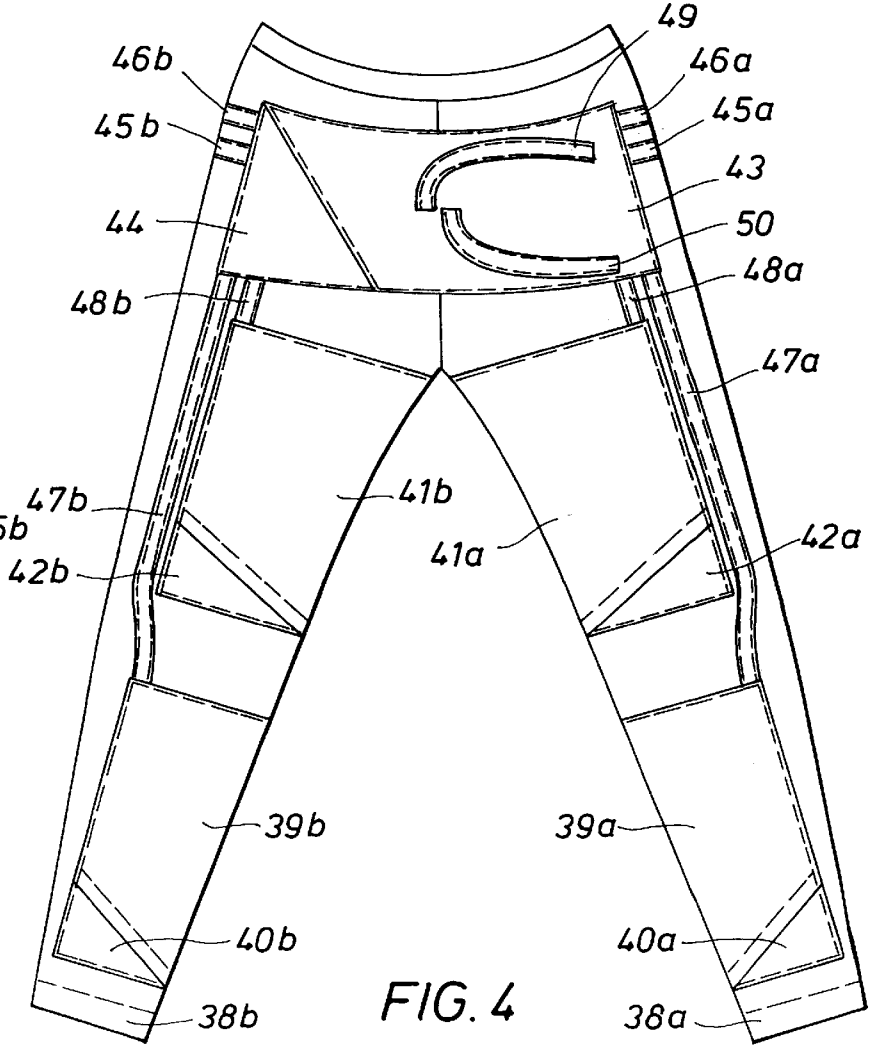
FIG. 4 is a back view of the preferred embodiment of the fabric component of the garment pant with pockets and tubing casings.
Figure 3:
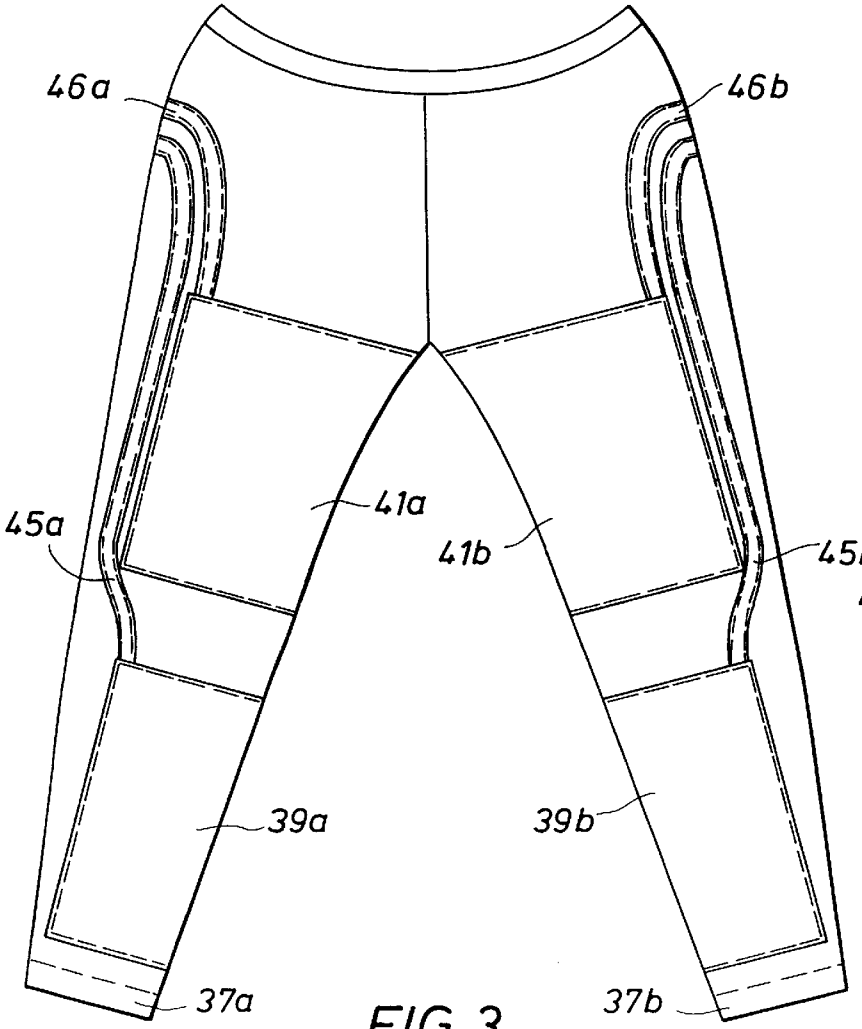
FIG. 3 is a front view of the preferred embodiment of the fabric component of the garment pant with pockets and tubing casings.
Figure 5:
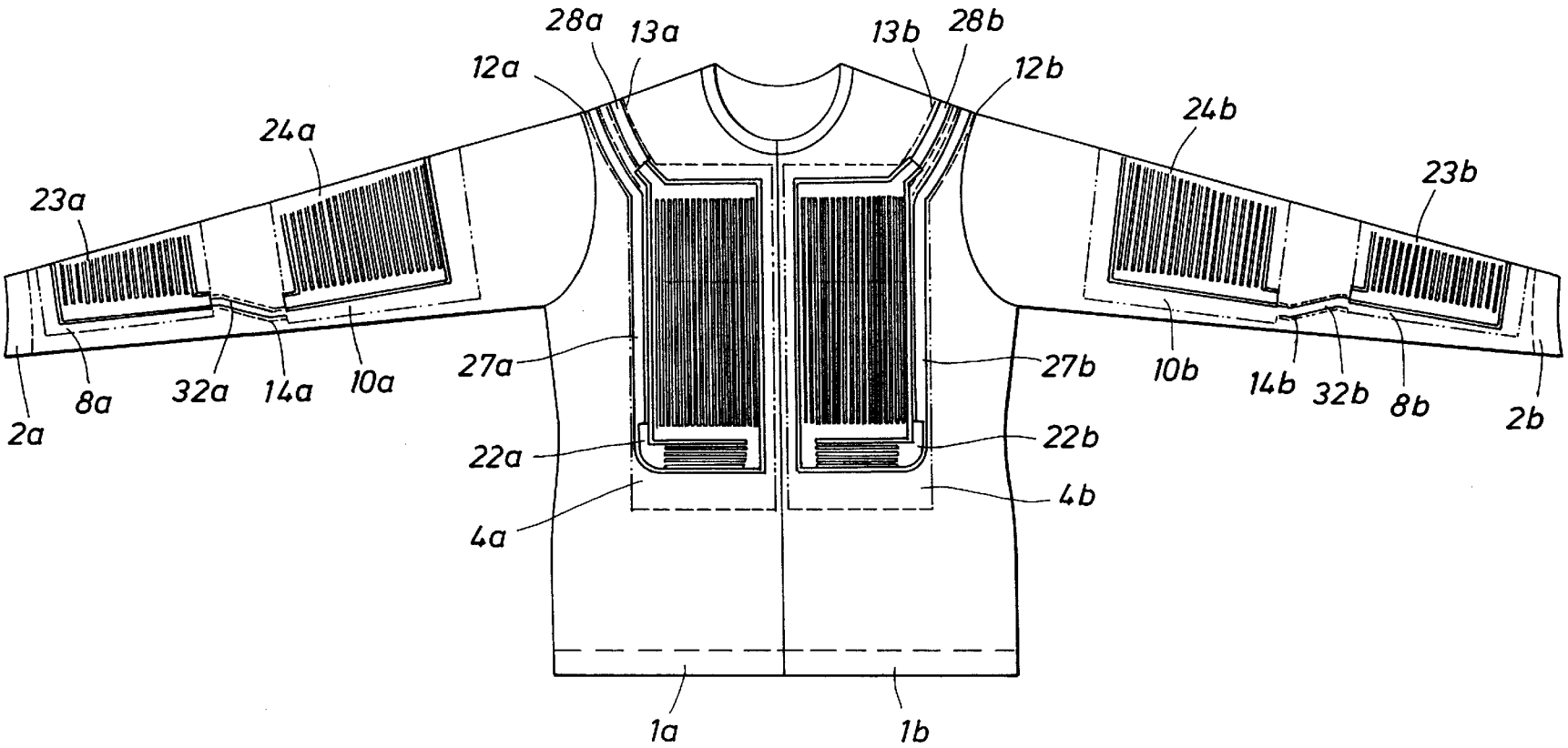
FIG. 5 is a front view of the preferred embodiment of the garment coat with the patches and tubing installed, and with pockets cut away to show the location of the patches and tubing.
Figure 6:
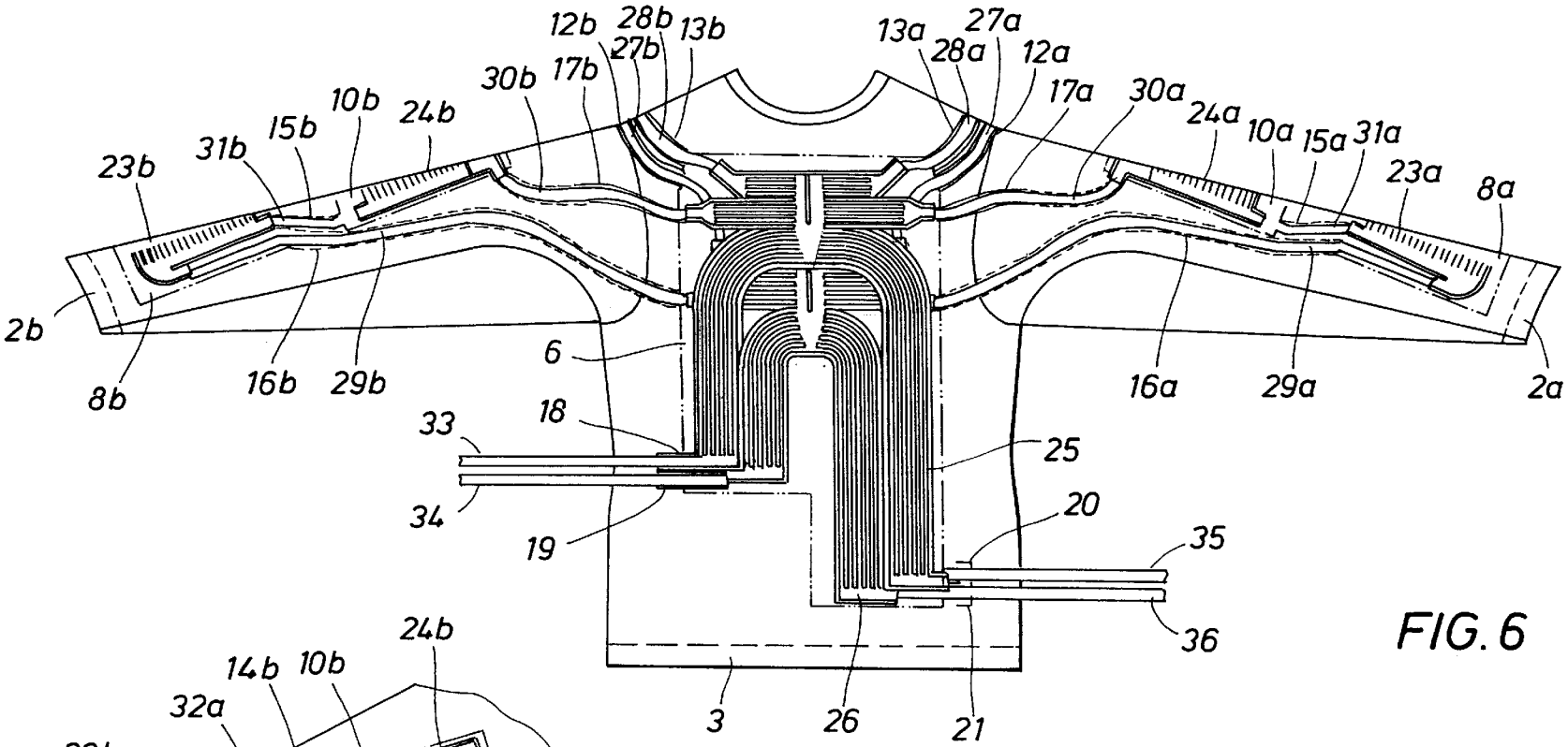
FIG. 6 is a back view of the preferred embodiment of the garment coat with the patches and tubing installed, similar to FIG. 5.
Figure 6A:
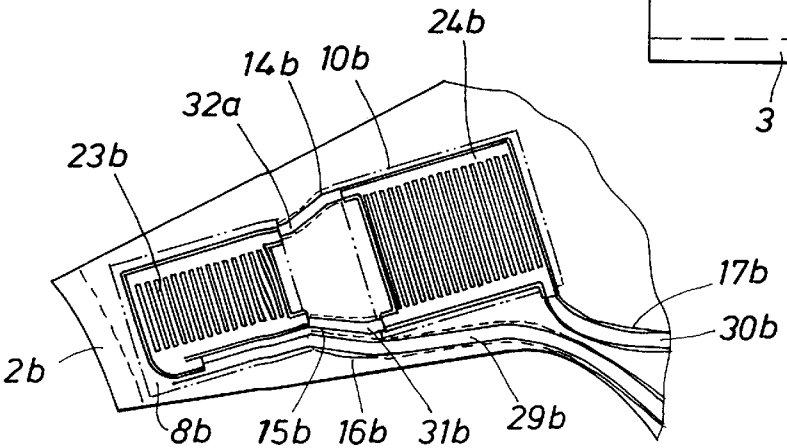
FIG. 6A is a view of the left sleeve of the garment shown in FIGS. 5 and 6, but opened flat, as in FIG. 2A.
Figure 8:
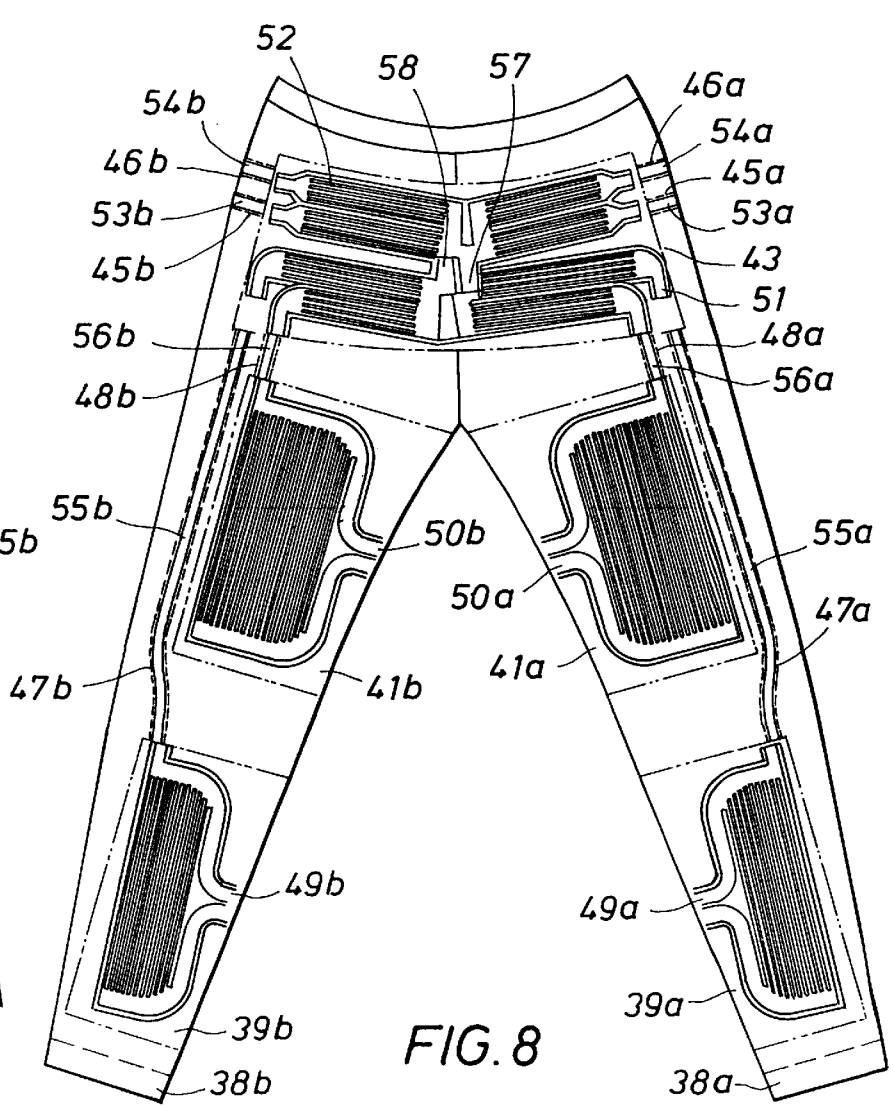
FIG. 8 is a back view of the preferred embodiment of the garment pant with the patches and tubing installed, similar to FIG. 7.
Figure 7:
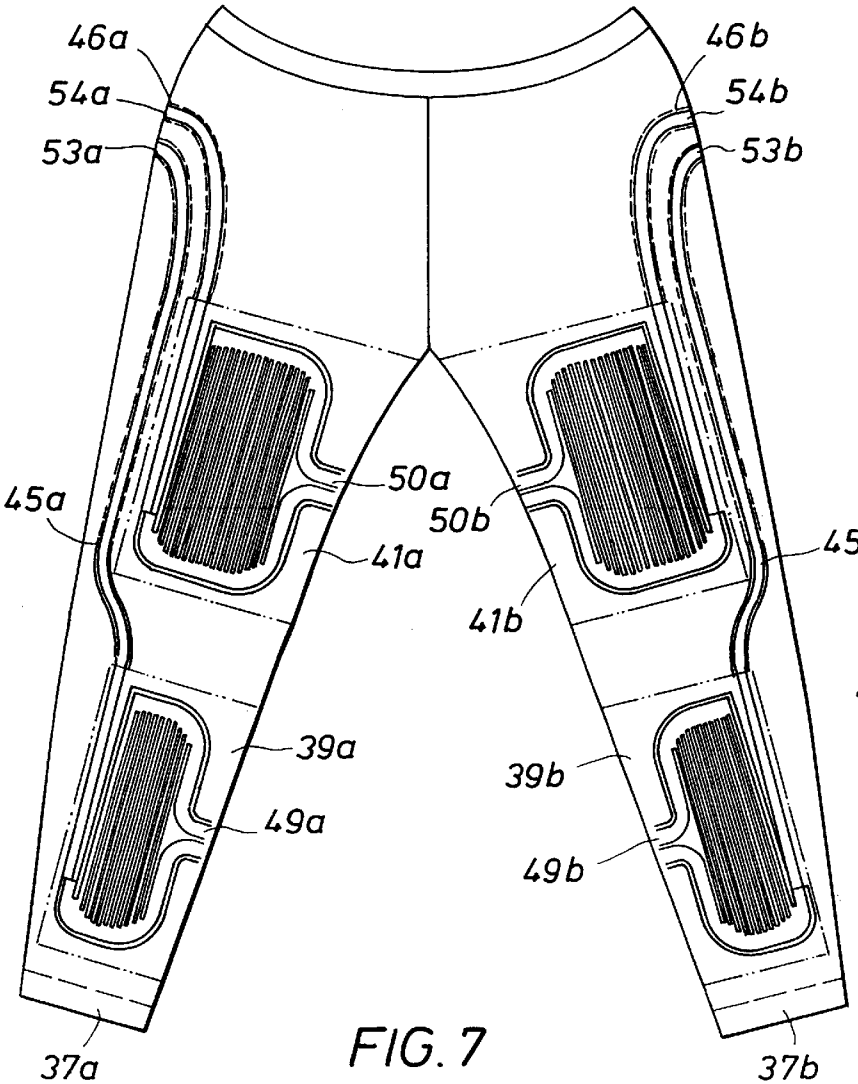
FIG. 7 is a front view of the preferred embodiment of the garment pant with the patches and tubing installed, and with a cut away pockets to show the location of the patches and tubing.

The pant in FIGS. 3 and 4 is of a typical pattern construction with right 37*a* and left 37*b* front panels, and right 38*a* and left 38*b* back panels. The panels of the pant are sewn together using typical seaming methods appropriate for the textile. The fronts 37*a*,37*b* of the pant are provided with the front half of lower extension leg pockets 39*a*,39*b*, and the front half of upper extension leg pockets 41*a*,41*b*. The backs 38*a*,38*b* of the pant are provided with the back half of lower extension leg pockets 39*a*,39*b*, pocket flaps 40*a*,40*b*, the back half of upper leg extension pockets 41*a*,41*b*, and pocket flaps 42*a*,42*b*. The back pocket 43 and pocket flap 44 extend over the upper portion of both pant backs 38*a*,38*b*.

The lower leg pockets 39*a*,39*b* are connected to the back pocket 43 by tube casings 45*a*,45*b* and 47*a*,47*b*. The upper leg pockets 41*a*,41*b* are connected to the back pocket 43 by tube casings 46*a*,46*b* and 48*a*,48*b*. The tube casings 49 and 50 are to accommodate the supply and return tubes between the coat and the pant.

FIGS. 5–8 show the pockets and tube casings cut away to show the patch detail and placement and the tubing. In the preferred embodiment, the tubes are glued to the sealed tubes within the patches.

For the coat (FIGS. 5 and 6), the right 22*a* and left 22*b* front patches are placed inside the front pockets 4*a*,4*b*. The lower sleeve patches 23*a* and 23*b* are placed inside the lower sleeve pockets 8*a* and b. The upper sleeve patches 24*a* and 24*b* are placed inside the upper sleeve pockets 10*a* and 10*b*. The coat supply manifold patch 26 and the return manifold patch 25 are both placed inside the back pocket 6.

The front supply tubes 27*a*,27*b* join the front patches 22*a*,22*b* to the coat supply manifold patch 26. The front return tubes 28*a*,28*b* join the front patches 22*a*,22*b* to coat return manifold patch 25. The sleeve supply tubes 29*a*,29*b* join the lower sleeve patches 23*a*,23*b* to the coat supply manifold patch 26. The sleeve return tubes 30*a*,30*b* join the upper sleeve patches 24*a*,24*b* to the coat return manifold 25. The upper 24*a*,24*b* and lower 23*a*,23*b* sleeve patches are joined respectively by tubes 31*a*,31*b*,32*a* and 32*b*. The garment supply tube 34 is held by the tube casing 19. The garment return tube 33 is held by the tube casing 18. The supply tube for the pants 36 is held by the tube casing 21. The return tube 35 for the pants is held by the tube casing 20.

For the pant (FIGS. 7 and 8), the upper leg patches 50*a*,50*b* are placed inside the upper leg pockets 41*a*,41*b*. The lower leg patches 49*a*,49*b* are placed inside the lower leg pockets 39*a*,39*b*. The pant supply manifold patch 52 and pant return manifold patch 51 are both placed inside the back pocket 43.

The front supply tubes 54*a*,54*b* join the upper leg patches 50*a*,50*b* to the pant supply manifold patch 52. The front supply tubes 53*a*,53*b* join the lower leg patches 49*a*,49*b* to the pant supply manifold patch 52. The back return tubes 55*a*,55*b* join the lower leg patches 49*a*,49*b* to the pant return manifold patch 51. The pant supply tube is 57 and the pant return tube is 58.

Figure 9:
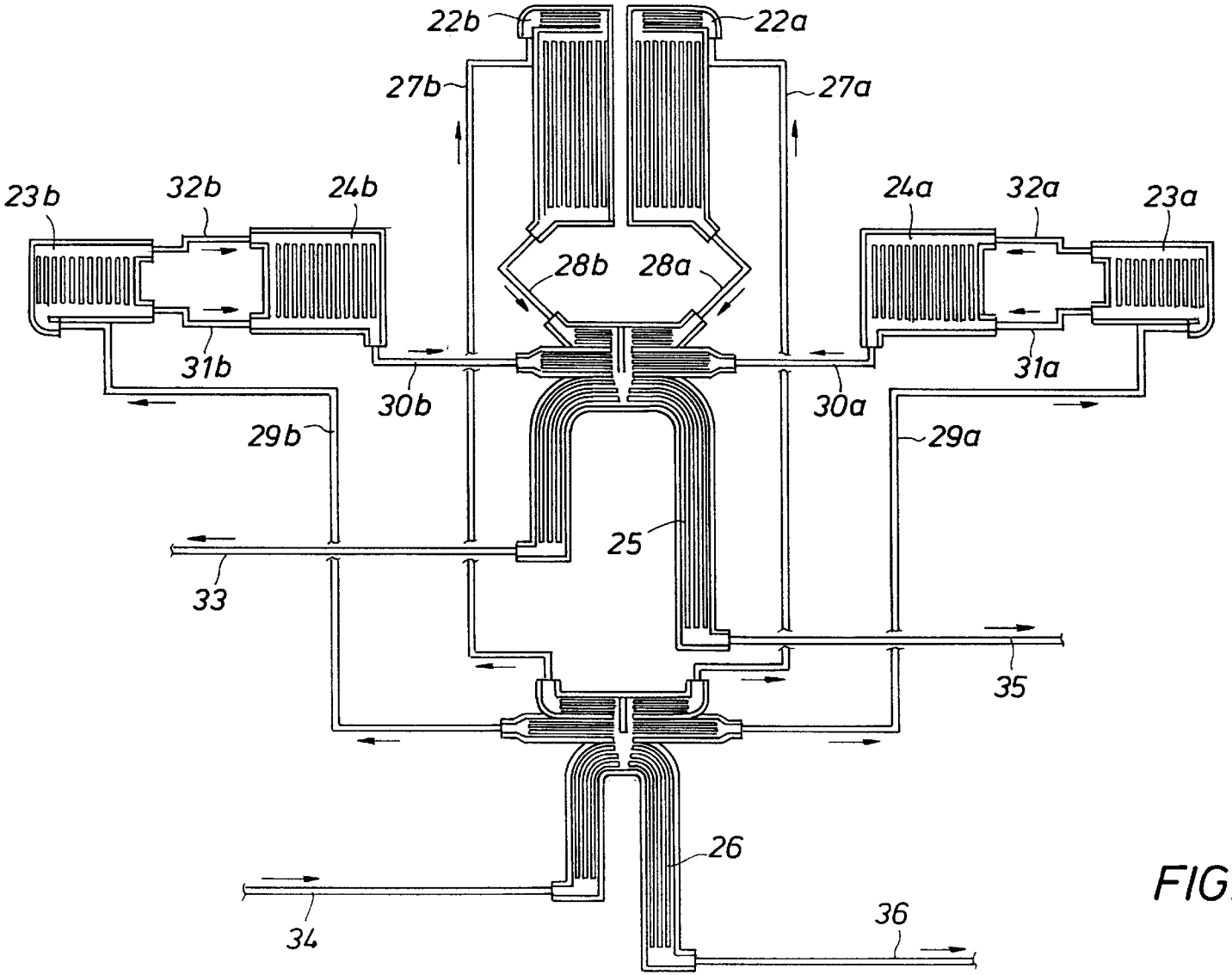
FIG. 9 is a flow schematic of the patch and tubing assembly of the preferred embodiment of the fluid circulating system for the coat.
Figure 10:
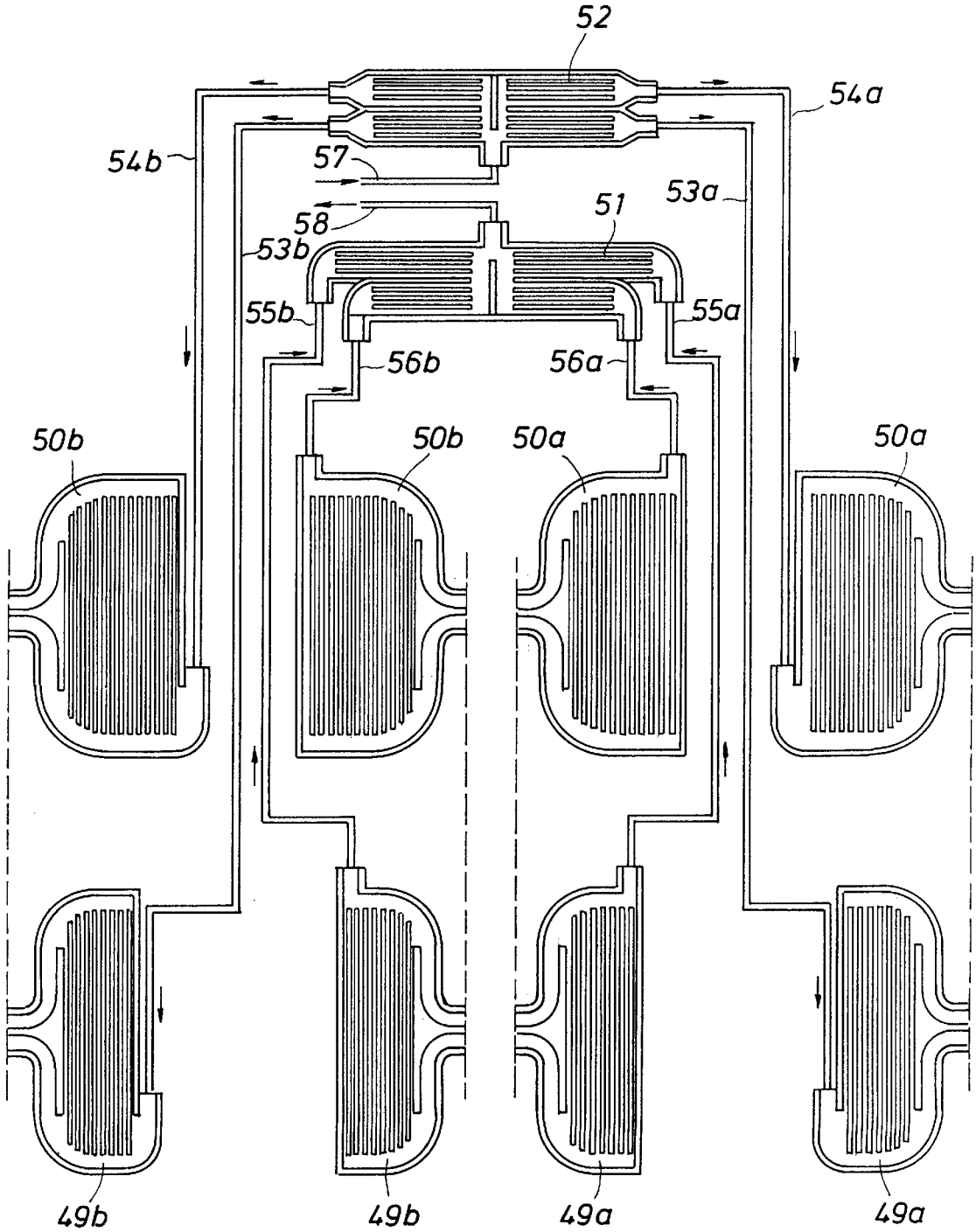
FIG. 10 is a flow schematic of the patch and tubing assembly of the preferred embodiment of the fluid circulating system for the pant.

FIGS. 9 and 10 diagram the flow path of the circulating fluid system. Within all of the patches the flow is split into small parallel flow channels.

The coat flow begins at tube 34 where the fluid enters the coat through the inlet header of the supply manifold patch 26. The outlets of patch 26 split the flow between tubes 29*a*,29*b*,27*a*,27*b* and 36 connecting with the outlet header. Those tubes supply patches 23*a*,23*b*,22*a*,22*b*, and the pant system respectively. The headers of patches 23*a* and 23*b* flow into tubes 31*a*,32*a* and 31*b*,32*b* respectively. Tubes 31*a*,32*a* and 31*b*,32*b* flow into the headers of patches 24*a*,24*b* respectively. The headers of patches 24*a*,24*b*,22*a*, and 22*b* flow into tubes 30*a*,30*b*,28*a*,28*b* respectively. Tubes 30*a*,30*b*,28*a*,28*b*, and 35 flow into headers of the coat return manifold patch 25. Patch 25 flows into tube 33 and the fluid exits the garment system.

The pant flow begins at tube 57 where the fluid enters a common header of the pant supply manifold patch 52. Divided headers at the outlets of patch 52 split the flow between tubes 54*a*,54*b*,53*a*, and 53*b*. Those tubes supply patches 50*a*,50*b*49*a*, and 49*b* respectively. Patches 50*a*,50*b*, 49*a* and 49*b* flow into tubes 56*a*,56*b*,55*a* and 55*b* respectively. Tubes 56*a*,56*b*,55*a* and 55*b* flow into a common outlet header of the pant return manifold patch 51. Patch 51 flows into tube 58 and the fluid exits the pant system.

FIG. 11 show a typical H-style patch with its flow paths through side by side patch sections connected by a flexible mid-section. The patch is typically constructed by RF welding two layers of polyurethane film together. The welds form the perimeter of the patch and the flow channels in the interior. Sealable tubing is RF welded into the openings of the patch with a 360° weld. The interior of the patch is made up of headers and areas of multiple parallel flow channels. Tube 59 forms the inlet of the patch. The fluid flows from tube 59 to header 61*a*. Part of the fluid continues through header 61*a* to header 61*b* and part of the fluid flows through the channels in area 63*a*. From 63*a* the fluid flows into header 62*a* and on to 62*b*. From header 61*b* the fluid flows through area 63*b* to header 62*b*. All the fluid exits the patch through outlet tube 60. This flow configuration provides flow to the left and right patch sections simultaneously. When placed around a limb this allows for even temperature distribution to the front and back of the limb with little encumbrance in between.

From the foregoing it will he seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may he made of the invention without departing from the scope thereof, it is to be understood that all matter herein set forth or shown in the accompanying drawings is to be interpreted as illustrative and not in a limiting sense.

What is claimed is:

1. An article for use in controlling body temperature, comprising:

a textile structure adapted to conform to the body surface and having a pocket with first and second openings in the edge thereof, and a casing extending from each opening, and a system through which a temperature controlling fluid may be circulated, including a patch disposable within the pocket and including side by side flow passages, a header at each end of the flow passages, an inlet to one header and an outlet from the other header, with the inlet and outlet being aligned, respectively, with the first and second pocket openings, and a pair of flexible tubes each extending through a casing and a pocket opening and having one end fluidly connecting with a header of the patch, whereby upon connection of the other ends of the tubes with a source of temperature controlled fluid, such fluid may be circulated through the system, the patch being free to move within its pocket and the tubes being free to move within their casings so that the system is freely moveable independently of the textile structure.

2. As in claim 1, wherein:

the textile structure is sufficiently flexible to fold about a substantial portion of a body limb.

3. As in claim 2, wherein:

the textile structure is formed of a stretchable fabric.

4. As in claim 1, wherein:

the patch comprises a pair of films sealed to one another along their edges and along spaced paths to form the flow passages between the headers.

5. As in claim 1, wherein:

the pocket and casings are sewn on one side of the textile structure.

6. As in claim 1, wherein the textile structure also has a second pocket with first and second openings in the edge thereof and a casing extending from each opening, and the system also includes a second patch disposable within the second pocket, a header at each end of the flow passages, an inlet to one header and an outlet from the other header, with the inlet and outlet being aligned, respectively, with the first and second pocket openings, and a pair of flexible tubes each extending through a casing and a pocket opening having one end fluidly connecting with a header of the second patch with the inlet and outlet being aligned, respectively, with the first and second pocket openings, the outlet of one being connected with the inlet of the other patch, so that there is series flow from one to the other.

7. As in claim 6, wherein:

the portion of the structure intermediate the pockets is flexible to permit the patches to be disposed over both ends of an articulated limb.

8. As in claim 1, wherein:

there are two or more patches removably disposable within a single pocket.

9. As in claim 1, wherein:

the patch has one inlet and multiple outlets.

10. As in claim 1, wherein:

the patch has one outlet and multiple inlets.

11. As in claim 1, wherein:

the patch includes a pair of patch end sections joined by a reduced mid section which is sufficiently flexible to permit the patch sections to be disposed over opposite sides of a limb, one patch section having a pair of outlet headers and the other patch section having a pair of inlet headers with the outlet headers fluidly connecting with the inlet headers within the mid section, and the flow passages of the patch sections extend parallel to one another.

12. An article for use in controlling body temperature, comprising:

a garment having a body section adapted to receive a portion of the torso of the wearer and extensions from the body section to receive the wearer's limbs, each of the body section and extensions having a pocket with first and second openings in the edge thereof, and casings each extending between the openings in the pockets of alternate patches, and a system through which a temperature controlling fluid may be circulated, including a patch disposable within each pocket and including side by side flow passages, a header at each end of the flow passages, an inlet to one header and an outlet from the other header, with the inlet and outlet being aligned, respectively, with the first and second pocket openings, and a pair of flexible tubes each extending through a casing and a pocket opening and having one end fluidly connecting with a header of the patch, whereby, upon connection of the other ends of the tubes with a source of temperature controlled fluid, such fluid may be circulated through the system, the patches being free to move within their pockets and the tubes being free to move within their casings so that the system is freely moveable independently of the garment.

13. As in claim 12, wherein:

each extension of the garment is sufficiently flexible to fold about a substantial portion of a body limb.

14. As in claim 12 wherein:

the garment is formed of a stretchable fabric.

15. As in claim 14, wherein:

each patch comprises a pair of films sealed to one another along their edges and along spaced paths to form the flow passages therebetween.

16. As in claim 12, wherein:

the pocket and casings are sewn on the front and back of the body section and along the extensions of the garment.

17. As in claim 12, wherein each of the garment extensions also has a second pocket with first and second openings in the edge thereof and a casing extending from each opening, and the system also includes a patch disposed within each second pocket, a header at each end of the flow passages thereof, an inlet to one header and an outlet from the other header, with the inlet and outlet being aligned, respectively, with the first and second pocket openings, and a pair of flexible tubes each extending through a casing and a pocket opening having one end fluidly connecting with a header of the second patch, the other ends of one tube of each patch connecting with one another so that there is series flow through the extension patches.

18. As in claim 17, wherein:

the portion of each extension intermediate the pockets thereof is flexible to permit the patches to be disposed over opposite sides of an articulated limb.

19. As in claim 12, wherein:

the garment is a coat in which the extensions are sleeves.

20. As in claim 12, wherein:

the garment is a pant in which the extensions are legs.

21. An article for use in controlling body temperature, comprising:

a garment including a pant and coat, each of the coat and pant comprising a body section adapted to surround upper and lower portions of the torso of the wearer, and extensions from each comprising arms of the coat and legs of the pant, each of the body section and extensions having a pocket with first and second openings in the edge thereof, and casings extending between the openings in the alternate pockets of each of the body section and extensions of each garment, a system through which a temperature controlling fluid may be circulated, including a patch disposable within each pocket and including side by side flow passages, a header at each end of the flow passages, an inlet to one header, an outlet from the other header, with the inlet and outlet being aligned, respectively, with the first and second pocket openings, and a pair of flexible tubes each extending through a casing and a pocket opening and having one end fluidly connected with the inlet or outlet of the patch aligned with the opening, and the tubes extending from the inlet of one patch and the outlet of another patch of the pant being connected to the outlet and the inlet of another patch, respectively, of the coat, whereby upon connection to tubes extending from the inlet of one patch and the outlet of another patch of the garment with a source thereof, temperature controlled fluid may be circulated through the system, the patches being free to move within its pocket and the tubes being free to move within their casings so that the system is freely moveable independently of the textile structure.

22. As in claim 12, wherein there are two or more patches removably disposable within a single pocket.

23. As in claim 12, wherein the patch has one inlet and multiple outlets.

24. As in claim 12, wherein the patch has one outlet and multiple inlets.

25. As in claim 12, wherein the patch includes a pair of patch end sections joined by a reduced mid section which is sufficiently flexible to permit the patch sections to be disposed over opposite sides of a limb, one patch section having a pair of outlet headers and the other patch section having a pair of inlet headers within the mid section, and the flow passages of the patch sections extend parallel to one another.

* * * * *